United States Patent [19]

Waters

[11] 4,149,588

[45] Apr. 17, 1979

[54] DRY COOLING SYSTEM

[75] Inventor: Elmer D. Waters, Richland, Wash.

[73] Assignee: McDonnell Douglas Corporation, Long Beach, Calif.

[21] Appl. No.: 666,650

[22] Filed: Mar. 15, 1976

[51] Int. Cl.[2] ..... F28B 1/06

[52] U.S. Cl. ..... 165/11; 60/692; 165/105; 165/110; 165/DIG. 1; 165/124

[58] Field of Search ..... 165/105, 11, 110, DIG. 1; 60/692

[56] References Cited

U.S. PATENT DOCUMENTS

| | | | |
|---|---|---|---|
| 837,499 | 12/1906 | Perkins et al. | 165/105 |
| 3,347,309 | 10/1967 | Webb | 165/105 X |
| 3,384,165 | 5/1968 | Mathews | 165/DIG. 1 |
| 3,572,426 | 3/1971 | Edwards | 165/105 X |

FOREIGN PATENT DOCUMENTS

| | | | |
|---|---|---|---|
| 739153 | 9/1943 | Fed. Rep. of Germany | 165/124 |
| 214877 | 5/1924 | United Kingdom | 165/105 |

*Primary Examiner*—Albert W. Davis, Jr.

*Attorney, Agent, or Firm*—Paul T. Loef; Walter J. Jason; Donald L. Royer

[57] ABSTRACT

A highly effective and efficient dry cooling system for dissipating waste heat of a steam-electric generating power plant. The dry cooling system includes an assembly of cells or modules having passively acting heat pipes installed in a Y configuration in each module. These heat pipes thermally couple the exhaust steam from a turbine flowing in a graded duct with the atmosphere. A large fan mounted at the top of each module is driven to induce air flow past exterior heat pipe portions of the module to dissipate heat picked up from the steam in the duct. The steam condensate flows down the graded duct and collects in a hot well for return as boiler feedwater. Steam from the boiler drives the turbine and is exhausted into the graded duct to repeat the cycle.

3 Claims, 26 Drawing Figures

DRY COOLING SYSTEM

BACKGROUND OF THE INVENTION

My present invention relates generally to thermal power plants. More particularly, the invention relates to a novel dry cooling module and system for dissipating the waste heat of a steam-electric generating power plant.

A modern steam-electric generating power plant produces steam by heating feedwater in a boiler with the heat generated from consuming fossil or nuclear fuel. The steam is used to drive a turbine which is mechanically coupled to an electric generator and the exhaust steam from the turbine is directed into a condenser. The condensate from the condenser is collected and returned as feedwater to the boiler. A suitable coolant is, of course, circulated through the condenser to cool and condense the steam therein. This coolant ordinarily is either a liquid or a gas. The liquid coolant used is normally water and the gaseous coolant used is usually air.

The modern steam-electric generating power plant has a thermal efficiency of about 40% and most of the remaining heat must be disposed of as waste. For a 1000-megawatt (MW) fossil fuel power plant, about 45% of the input heat energy is discharged through the condenser coolant and about 15% is lost up the smokestack and in the ash. The condenser commonly used to condense the exhaust steam from the turbine employs water as the coolant which is circulated through the condenser. Condenser cooling water flows of over 400,000 gallons per minute (gpm) are necessary for 1000 MW power plants, for example. While air is a perfectly good coolant, condensers employing air as the coolant to condense the exhaust steam from the turbine would require very large areas of heat exchange surfaces and huge volumes of air circulated thereover for the 1000 MW power plants.

In many of these power plants, the condenser cooling water is obtained from one point of a river, lake or sea and circulated once through the condenser. This heated water is then returned to its source at another nearby point thereof. The heat load deposited by the returned water in its source may create potential thermal effects, however, and such once-through cooling is becoming less acceptable environmentally. To avoid any thermal effects, large cooling ponds are often utilized or cooling canals can be used wherein the heated water from the condenser enters at one end of a canal, cools naturally as the water traverses the canal's length, and exits suitably cooled at the other end into a river, lake or sea.

Still, there are other problems involved with once-through cooling. It is, for example, more difficult to control the quality of the cooling water received from a river, lake or sea because of its variable concentration of salts and other impurities. Also, and of increasing importance, the rapid growth in demand for more power everywhere is continually diminishing the adequacy of available cooling water supplies.

In order to reduce the quantity of cooling water supply needed for eliminating the waste heat of a large power plant, both air and water can be used as coolants. In this instance, the cooling water heated following circulation through the condenser of the power plant can be cooled by evaporative cooling or dry cooling in a "wet" cooling tower or "dry" cooling tower, respectively, and the cooled water recirculated to the condenser to repeat the cycle. Air from the atmosphere is the coolant circulated once through either the wet or dry cooling towers.

In the wet cooling tower, the cooling water heated from circulation through the condenser is caused to fall through a draft of air and most of the heat is dissipated to the atmosphere by evaporation of a small portion of the cooling water. The rest of the water is collected at the bottom of the tower and returned to the condenser for recycling. In the dry cooling tower, the heated cooling water from the condenser passes through heat exchange cooling coils of the tower and a draft of atmospheric air is circulated exteriorly of the cooling coils. The cooled water is collected from the coils at the bottom of the tower and returned to the condenser for recycling.

The wet cooling tower is, of course, more effective and efficient than the dry cooling tower. However, there are greater losses of the circulating water with the wet cooling tower due to blowdown (process of bleeding off part of the water to remove dissolved salts or other impurities which might interfere with system operation), drift (water loss from the tower as fine liquid droplets carried off by the air coolant), evaporation, and leakage. There are, for example, roughly 0.3% (of the water circulated) in blowdown loss, 0.2% in drift loss and 1% in evaporation loss for each 10° F. of cooling accomplished. Makeup water required is of the order of 12,000 gpm for the 1000 MW power plants with cooling water flows of over 400,000 gpm to provide a tower cooling range of about 20° or 30° F.

In addition, the wet cooling tower can cause undesirable fogging and icing conditions at certain times and which conditions often turn out to be quite hazardous. These conditions are avoided with the dry cooling tower which is also easier to maintain than the wet cooling tower. As mentioned previously, however, very large areas of heat exchange surfaces are required in the dry cooling tower and the cooling coils providing such surfaces can make the conventional dry cooling tower over twice as expensive as a comparable wet cooling tower.

SUMMARY OF THE INVENTION

Briefly, and in general terms, my invention is preferably accomplished by providing a highly effective and efficient dry cooling system of novel configuration and structure which is low in cost to construct and requires very little maintenance over an exceptionally long life. This dry cooling system includes an assembly of cells or modules having passively acting heat pipes installed in a Y configuration in each module and which thermally couple the exhaust steam from a turbine flowing in a graded duct with the atmosphere exterior thereto. The steam driven turbine is normally coupled mechanically to an electric generator.

The Y configuration modules are positioned along the length of the graded steam duct with the heat pipes extending down vertically into it, transversely to the direction of steam flow in the duct. The angled upper portions of the heat pipes are suitably finned and exposed to the atmosphere. A large fan is mounted at the upper end of each module and driven to induce a draft past the angled upper portions of the heat pipes. The heat picked up by the lower portions of the heat pipes from the steam flowing in the graded duct is transported to the angled upper portions and transferred to the induced draft of air flow for dissipation to the atmosphere.

Some of the steam impinging against the lower portions of the heat pipes in the graded duct is, of course, condensed and falls to the bottom of the duct. This condensate will flow along the graded lower surface of the steam duct down its length to collect in a hot well or condensate receiver at the end of the duct. A condensate pump is used to circulate the water from the hot well or condensate receiver to a boiler or steam generator for re-evaporation. This steam drives the turbine and its exhaust steam is provided into the graded duct to repeat the cycle.

The dry cooling system cells or modules can be arranged in different patterns varying according to the environmental conditions of a chosen location for the associated power plant. These patterns would be dependent upon the prevailing wind direction at any particular location, the contours of the surrounding terrain and the available land area, for example. Thus, in a first system, the exhaust steam from a turbine is directed into a long graded duct and the modules are positioned along its length in a single row. The graded steam duct and its row of modules can be curved or straight, as may be required.

In a second system, the exhaust steam from a turbine is directed into two adjacent and parallel graded ducts. The cells or modules are positioned along the lengths of these ducts in two adjacent and parallel rows. Of course, these rows would be much shorter than the single row system for power plants of a similar size. Finally, in a third system, the exhaust steam is directed into two graded ducts which are semicircularly curved along their lengths so that the two ducts together form a circular pattern. The modules positioned along the lengths of the semicircularly curved ducts do not include draft fans, however, and only a few larger size fans are located in the area surrounded by the circular duct pattern. These larger fans are utilized to induce an air flow through the surrounding modules arranged in the circular pattern.

A novelty search on the present invention did not produce any references disclosing a dry cooling system including an assembly of cells or modules having passively acting heat pipes installed in a Y configuration in each module. Heat exchange devices of various configurations were, however, disclosed by various references developed in the search. Notable among the developed references were U.S. Pat. No. 3,305,006 of John H. Daltry on Cooling Towers patented Feb. 21, 1967 and U.S. Pat. No. 3,384,165 of Ralph T. Mathews on Heat Exchanger patented May 21, 1968.

The Daltry and Mathews patents disclose heat exchange structures which are characterized generally by an upright V configuration. The heat transfer tubes in both of the Daltry and Mathews heat exchange structures are not heat pipes and actually carry the steam condensate or steam and its condensate. Further, the adjacent heat exchanger elements in the Daltry structure are arranged in a zig-zag fashion in each line and the heat transfer tubes in the Mathews structure are disposed horizontally. Clearly, the Daltry and Mathews heat exchange structures are fully different from that of the present invention.

Other references of general interest produced in the novelty search were U.S. Pat. Nos. 1,690,108; 1,725,906; 1,988,494; 2,449,110; 2,529,915; 3,150,267; 3,174,540; 3,444,419; 3,635,042; 3,685,579; 3,727,679; 3,788,388; 3,818,983; 3,831,667 and 3,851,474. These references disclose other heat exchange structures and related cooling systems for power plants. Although a diverse showing of various heat transfer devices and systems was developed, the references are believed to be of no greater pertinency than those discussed above.

BRIEF DESCRIPTION OF THE DRAWINGS

My invention will be more fully understood, and other advantages and features thereof will become apparent, from the following description of certain exemplary embodiments of the invention. This description is to be taken in conjunction with the accompanying drawings, in which.

DESCRIPTION OF THE PRESENT EMBODIMENTS

In the following description and accompanying drawings of the exemplary embodiments of my invention, some specific values and types of materials are disclosed. It is to be understood, of course, that such specific values and types of materials are given as examples only and are not intended to limit the scope of this invention in any manner.

Figure 1:
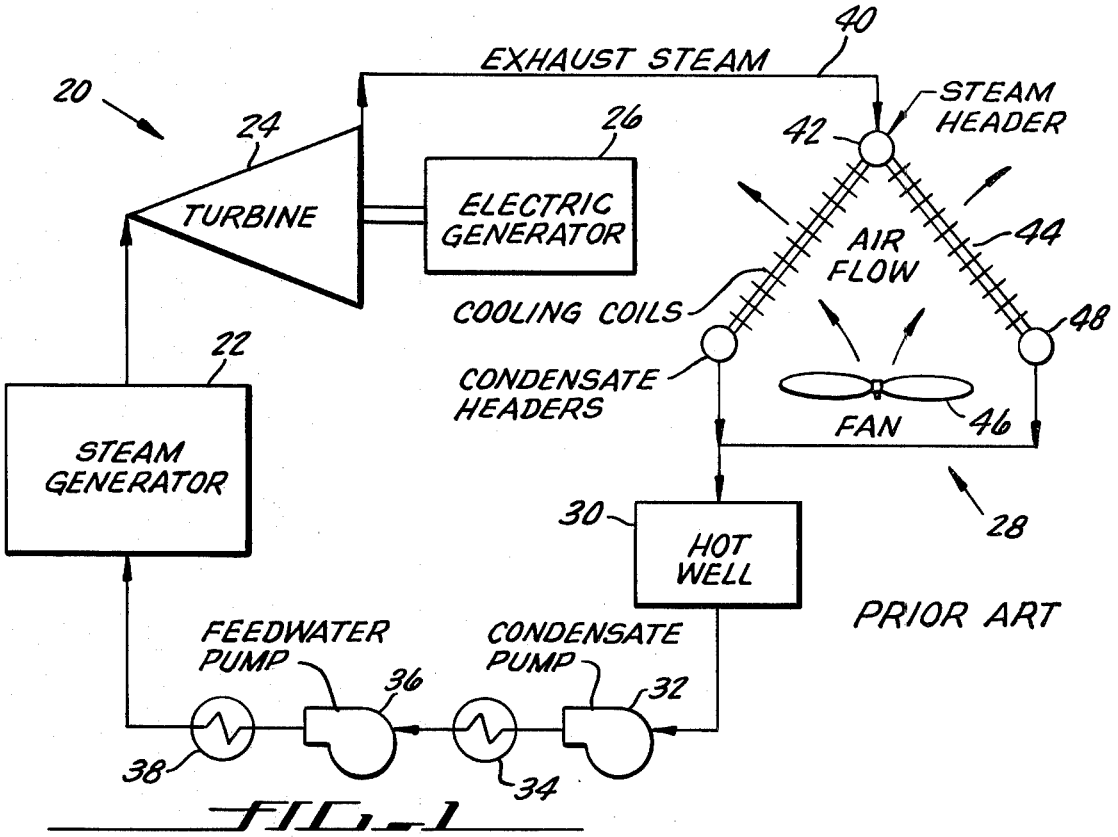
FIG. 1 is a drawing of a conventional direct condensing type of dry cooling tower system which is schematically shown in generally diagrammatic form.

FIG. 1 is a drawing of a conventional direct condensing type of dry cooling tower system 20 which is schematically shown in generally diagrammatic form. The system 20 is one of two basic types of dry cooling tower systems which are in present use. The direct condensing cooling tower system 20 includes, for example, a steam generator 22, a turbine 24 driven by the steam from the steam generator, an electric generator 26 mechanically coupled to the turbine, a dry cooling tower 28 for condensing exhaust steam from the turbine, a hot well or condensate receiver 30, condensate pump 32, condensate heater 34, feedwater pump 36, and feedwater heater 38 providing water of suitable condition to the steam generator for re-evaporation.

In the direct condensing, dry cooling tower system 20, the exhaust steam from the turbine 24 is conveyed through a very large duct or trunk 40 to the steam header 42 and cooling coils 44 of the tower 28. The duct 40 is large in cross-sectional open area to minimize pressure drop and places some limit on the size of the power plant. The exhaust steam of the turbine 24 enters from the top of the air-cooled coils 44 and condenses as it travels downward. A draft is mechanically produced by fan 46 which causes air to flow past the cooling coils 44. Steam and condensate both flow in the same direction down the coils 44 into condensate headers 48. The heavier condensate collects in the lower part of the headers 48 and flows by gravity to the hot well or condensate receiver 30. Condensate pump 32, condensate heater 34, feedwater pump 36, and feedwater heater 38 circulate and condition the water from the hot well or condensate receiver 30 to the steam generator 22 for re-evaporation. The method of air or noncondensable gas removal (as by ejectors) is not shown in FIG. 1 but typically is necessary.

Figure 2:
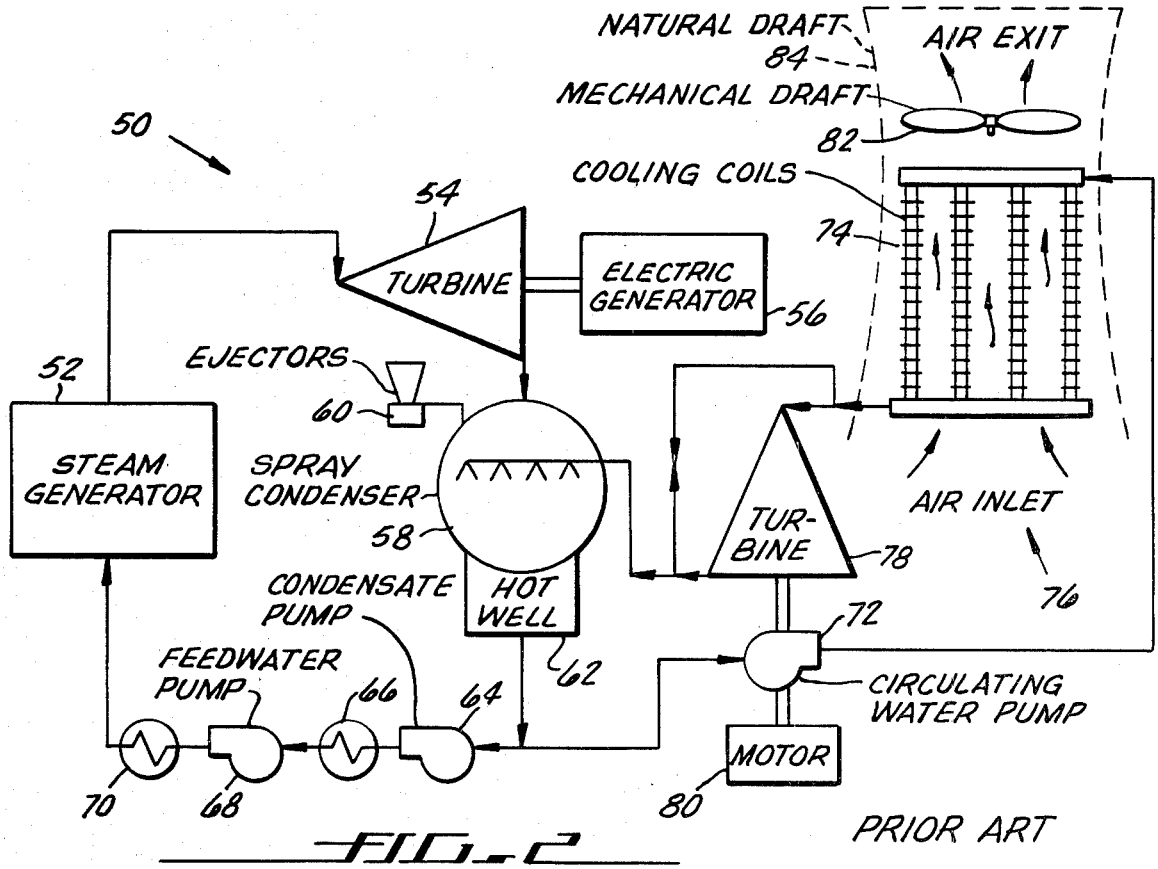
FIG. 2 is a generally diagrammatic and schematic drawing of a conventional indirect condensing type of dry cooling tower system.

FIG. 2 is a drawing of a conventional indirect condensing type of dry cooling tower system 50 which is schematically shown in generally diagrammatic form. The indirect condensing cooling tower system 50 includes, for example, a steam generator 52, a turbine 54 driven by the steam from the steam generator, an electric generator 56 mechanically coupled to the turbine, spray condenser 58 with ejectors 60 (for removal of air of noncondensable gas) and hot well or condensate receiver 62, condensate pump 64, condensate heater 66, feedwater pump 68, and feedwater heater 70 providing water of proper condition to the steam generator for re-evaporation.

The system 50 also includes a circulating water pump 72 for circulating part of the condensate from the hot well or condensate receiver 62 to the cooling coils 74 of a dry cooling tower 76, a water recovery turbine 78 through which cooled water from the tower passes prior to introduction into the spray condenser 58, and a drive motor 80 mechanically coupled to the circulating water pump. The recovery turbine 78 is mechanically coupled to the drive shaft of the circulating water pump 72 to effect some energy recovery. A draft is mechanically produced by fan 82 or can be naturally produced by using a hyperbolic shell structure 84 (shown in broken lines).

In the indirect condensing, dry cooling tower system 50, the exhaust steam from the turbine 54 is directed to the interfacing spray condenser 58 and mixes intimately with cool water sprayed into the condenser. This mixture collects in the hot well or condensate receiver 62 and the greater part of the water is pumped by circulating water pump 72 to the cooling coils 74 of the tower 76. The cooled water from the tower 76 is passed through the recovery turbine 78 to the spray condenser 58. The other part of the water from the hot well or condensate receiver 62 is pumped and conditioned by condensate pump 64, condensate heater 66, feedwater pump 68 and feedwater heater 70 to the steam generator 52 for re-evaporation. The recovery turbine 78 is an optional component for the system 50 and is used to recover some of the pressure head between the cooling coils 74 and the spray condenser 58.

The direct condensing system 20 (FIG. 1) must handle a large volume of exhaust steam which is directly cooled and condensed in the cooling coils 44 of the dry tower 28. These cooling coils 44 operate under a high vacuum in the system 20. Large steam ducts are required to carry the exhaust steam from the turbine 24 to the remote cooling coils 44 and, consequently, the direct condensing systems are generally limited to power plants of smaller sizes. On the other hand, the indirect condensing system 50 (FIG. 2) utilizes an interfacing spray condenser 58 which can be located close to the turbine 54 to obviate the requirement for large connecting steam ducts. Of course, small water pipes can be used to carry the much smaller volume of circulating water from the hot well or condensate receiver 62 to the cooling coils 74 of the dry tower 76. These cooling coils 74 operate under positive water pressure in the system 50. Since large connecting steam ducts are not required, the indirect condensing systems are generally more economical and technically feasible for power plants of larger sizes.

Figure 3:
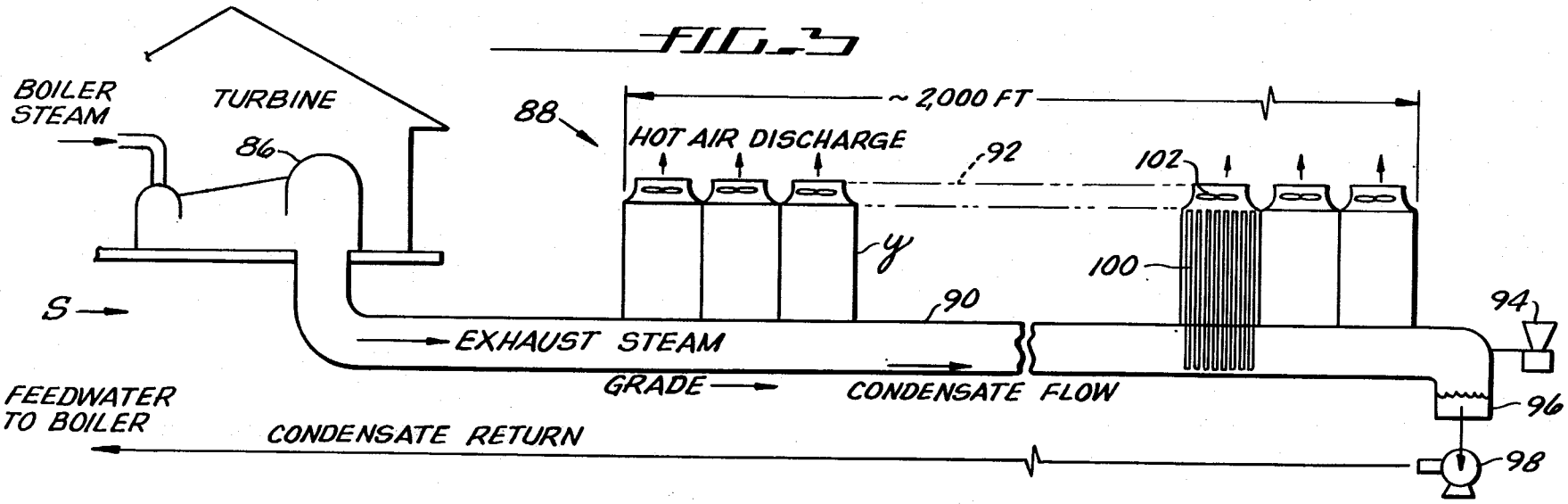
FIG. 3 is a simplified side elevational view; shown partially in diagrammatic and schematic form, of a dry cooling system constructed in accordance with this invention.

FIG. 3 is a simplified side elevational view, shown partially in diagrammatic and schematic form, of a dry cooling system S constructed in accordance with this invention. Steam from a power plant boiler (not shown) is used to drive a turbine 86 which is mechanically coupled to an electric generator (also not shown) and the exhaust steam from the turbine is directed into condenser means 88. The condenser means 88 includes a graded duct 90 into which is directed the exhaust steam, and a dry cooling assembly 92 having a plurality of cells or modules y positioned along the length of the duct, ejectors 94 located near the end of the duct and a hot well or condensate receiver 96 at the end of the duct. A condensate pump 98 is provided to return the condensate from the hot well 96 as feedwater to the boiler for re-evaporation.

Each of the cells or modules y of the assembly 92 comprises a group of passively acting heat pipes 100 arranged in a predetermined configuration, and a draft fan 102 mounted at the normally upper end of this configuration. These heat pipes 100 are installed in each module y to couple the exhaust steam flowing in the graded duct 90 thermally with the atmosphere exterior thereto. The lower portions of the heat pipes 100 extend vertically down into the steam duct 90, and the upper portions are suitably finned and exposed to the atmosphere. The graded steam duct 90 preferably tapers with length so that its open cross-sectional area is progressively decreased. This can be accomplished by gradually reducing just the width of the steam duct 90 continuously along its length or discretely along its length in successive sections of the modules y.

The heat picked up by the lower portions of the heat pipes 100 from the steam flowing in the graded duct 90 is transported by the working fluid in the heat pipes to their finned upper portions. The draft fan 102 induces an air flow past the upper portions of the heat pipes 100 so that the transported heat is transferred thereto and dissipated to the atmosphere. Of course, some of the steam flow impinging against the lower portions of the heat pipes 100 in the graded duct 90 is condensed and drops to the bottom of the duct. This condensate flows along the graded lower surface of the steam duct 90 and collects in the hot well 96 at the end thereof. The pump 98 returns the collected condensate as feedwater to the boiler for re-evaporation into steam which drives the turbine 86. The exhaust steam from the turbine 86 is directed into the condenser means 88 to repeat the cycle.

Figure 4:
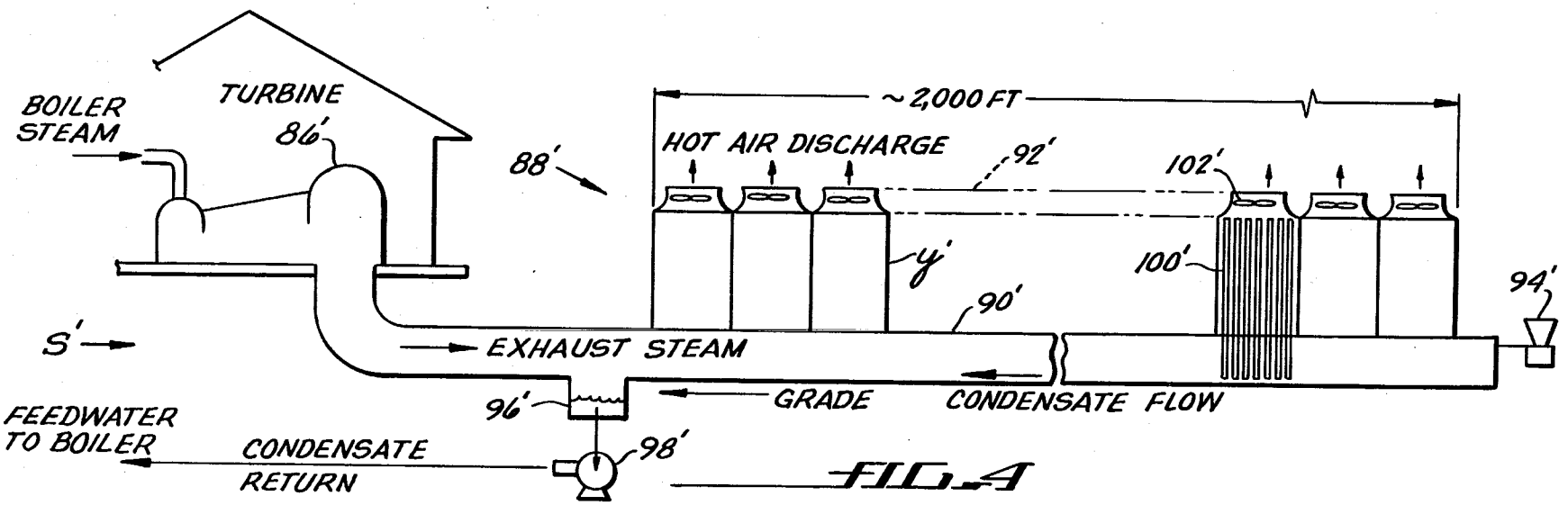
FIG. 4 is a simplified side elevational view, also shown partially in diagrammatic and schematic form, of a variation of the dry cooling system of FIG. 3.

FIG. 4 is a simplified side elevational view, shown partially in diagrammatic and schematic form, of another dry cooling system S' which is a variation of the dry cooling system S of FIG. 3. The second system S' differs from the first system S in that steam duct 90' is graded in a direction opposite to that of the steam duct 90 and hot well or condensate receiver 96' is located near the beginning of the dry cooling assembly 92' of cells or modules y' instead of near the end like the hot well or condensate receiver 96. Thus, condensate pump 98' can be located much closer to the power plant boiler (not shown) in the system S' and, further, the counterflow of condensate and exhaust steam in the graded duct 90' eliminates or minimizes subcooling of the condensate (feedwater) for the boiler. Of course, the overall function and purpose of the second dry cooling system and modules S' and y' are the same as those of the first dry cooling system and modules S and Y.

The cells or modules y' of the dry cooling system S' of FIG. 4 can be similar to the cells or modules y of the dry cooling system S of FIG. 3. Each of the modules y' used in the system S' are also preferably of such a Y configuration. The Y configuration cells or modules y and y' were found to be particularly advantageous from basic considerations of (a) minimizing recirculation of hot air back into a cooling module, (b) total land area required, (c) configuration of site plot and other structures, (d) contour of site, and (e) steam duct and condensate return structure construction. All of these items are quite dependent on module configuration.

Figure 5A:
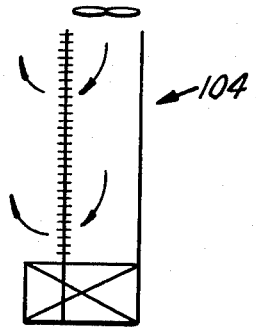
FIGS. 5A, 5B, 5C, 5D, 5E, 5F, 5G, 5H, 5I, 5J, 5K and 5L are simplified front elevational views, shown in somewhat diagrammatic and schematic form, of various configurations of cells or modules which can be used in the dry cooling system of this invention.
Figure 5B:
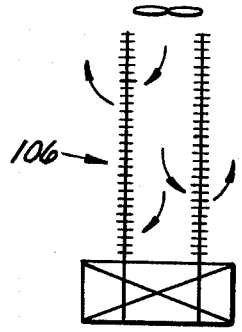
Figure 5C:
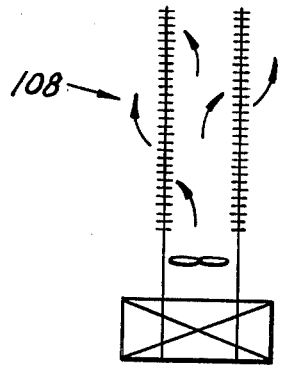
Figure 5D:
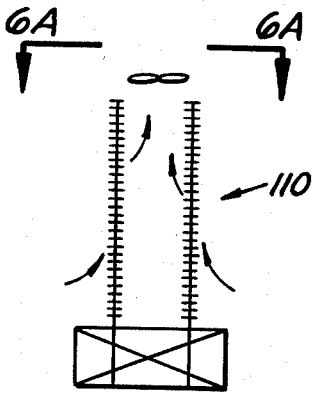
Figure 5E:
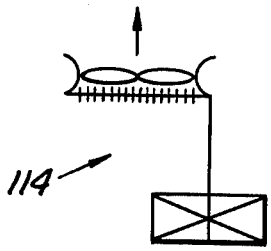
Figure 5F:
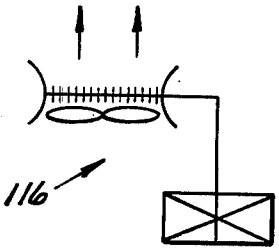
Figure 5G:
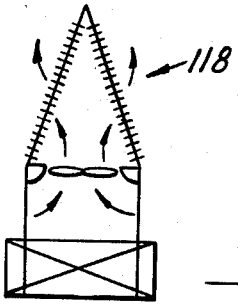
Figure 5H:
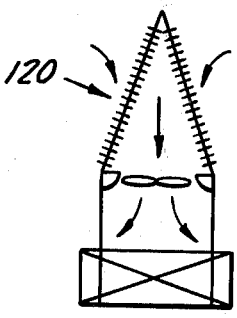
Figure 5I:
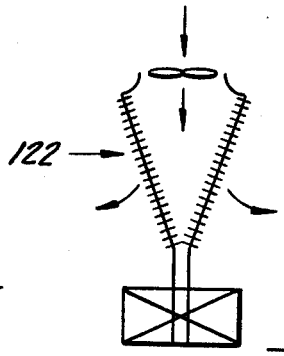
Figure 5J:
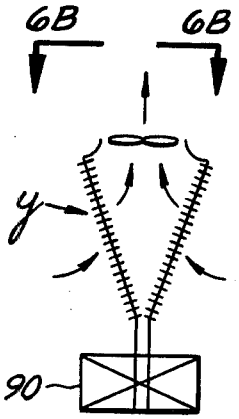
Figure 5K:
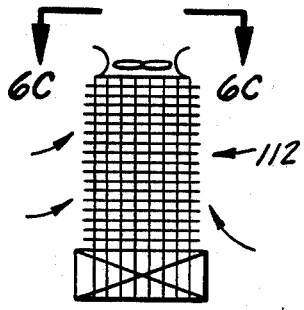
Figure 5L:
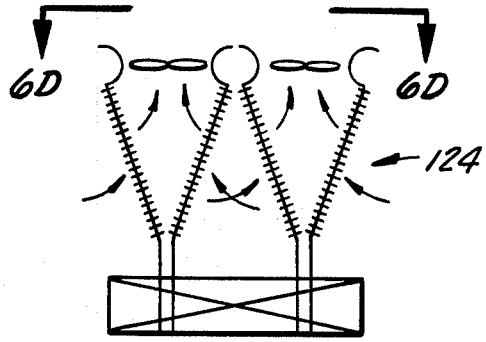

FIGS. 5A through 5L are simplified front elevational views, shown in somewhat diagrammatic and schematic form, of various cell or module configurations which can be used in the dry cooling systems S and S' of FIGS. 3 and 4, respectively. Generally, these heat pipe modules take one of four configurations (vertical, horizontal, A-shape or Y-shape), use a forced draft or induced draft, and have an upflow of air, downflow of air or horizontal air flow (not shown). Vertical configuration heat pipe modules 104, 106, 108, 110 and 112 are respectively illustrated in FIGS. 5A, 5B, 5C, 5D and 5K, and horizontal configuration heat pipe modules 114 and 116 are respectively shown in FIGS. 5E and 5F. A-shaped heat pipe modules 118 and 120 are illustrated in FIGS. 5G and 5H, respectively, and Y-shaped heat pipe modules 122, y and 124 are shown in FIGS. 5I, 5J and 5L, respectively.

The heat pipe modules 104, 106, 108, 116, 118 and 122 respectively of FIGS. 5A, 5B, 5C, 5F, 5G and 5I employ a forced draft whereas the heat pipe modules 110, 114, 120, y, 112 and 124 respectively of FIGS. 5D, 5E, 5H, 5J, 5K and 5L employ an induced draft. There is an upflow of air in the modules 108, 110, 114, 116, 118, y, 112 and 124 whereas there is a downflow of air in the modules 104, 106, 120 and 122. The Y-shaped modules 122 and y will minimize the land area required. Further, the Y shape minimizes changes in air flow direction and velocity.

An upward flow of air in a heat pipe module utilizes the bouyancy effect of the heated air to aid flow and this amounts to a few percent of the pressure difference ($\Delta P$) required to produce suitable air flow through the heat pipe banks. It has also been shown that cooling modules using fans to produce an induced draft of vertical (upward) air flow have much less recirculation of hot air than cooling modules using fans to produce a forced draft of similar air flow. Thus, the heat pipe module y of FIG. 5J is the optimum and preferred cooling module which is used in the dry cooling system S of FIG. 3.

Figure 6A:
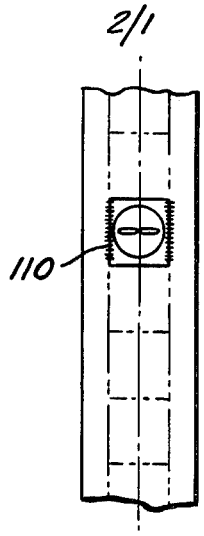
FIGS. 6A, 6B, 6C and 6D are top plan views of certain ones of the cells or modules as taken along the lines 6A—6A, 6B—6B, 6C—6C and 6D—6D indicated respectively in FIGS. 5D, 5J, 5K and 5L.
Figure 6B:
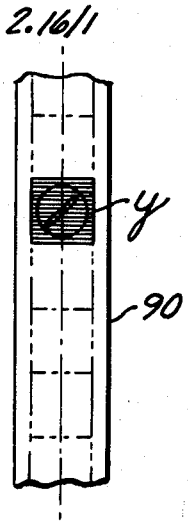

FIGS. 6A through 6D are top plan views of the cells or modules 110, y, 112 and 124 as taken along the lines 6A—6A, 6B—6B, 6C—6C and 6D—6D indicated respectively in FIGS. 5D, 5J, 5K and 5L. The "packing density" of the heat pipe module 110 on its steam duct is 2/1 as indicated in FIG. 6A. This packing density number gives the relative air-cooled surface area of the module 110 per unit length of steam duct. The packing densities of the modules y, 112 and 124 of FIGS. 6B, 6C and 6D, respectively, are 2.16/1, 2.83/1 and 4.32/1. It can be readily seen that the Y-shaped module y of FIG. 6B has a packing density advantage over the vertical configuration module 110 of FIG. 6A.

Figure 6C:
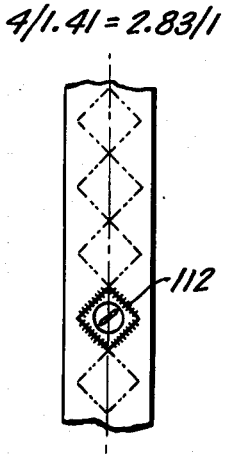
Figure 6D:
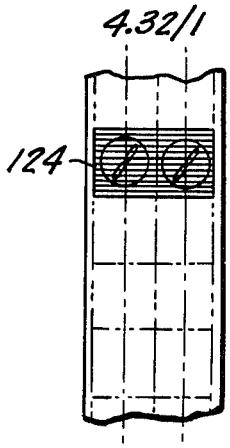

For heat pipe modules of greater complexity, the double Y-shaped module 124 of FIG. 6D likewise has a packing density advantage over the quadrilateral vertical configuration module 112 of FIG. 6C. To achieve the full packing density of the double Y-shaped module 124, however, an extra wide steam duct is required. This extra wide steam duct can, of course, be equivalent to (or formed from) two longitudinally contiguous and parallel steam ducts of normal width. Alternatively, a steam duct of normal width can be used by providing appropriate and extra bends in the lower unfinned portions of all of the heat pipes so that such lower portions can be suitably positioned in the normal width steam duct. Longer heat pipe lower portions are, however, required in this instance to accommodate the extra bends.

Figure 7:
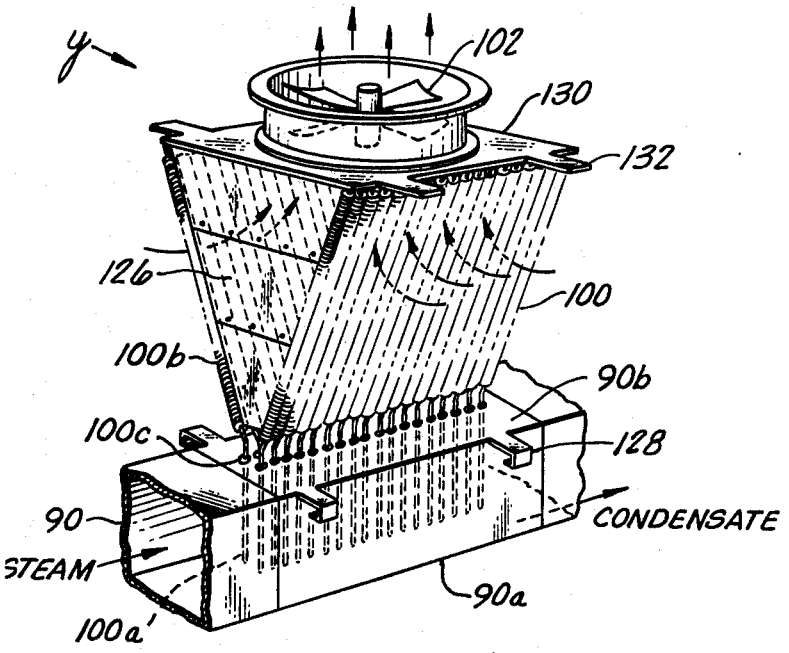
FIG. 7 is an isometric drawing of the Y configuration cell or module shown in FIG. 5J.

FIG. 7 is an isometric drawing of the Y configuration heat pipe module y shown in simplified form in FIG. 5J. The module y includes a group of passively acting heat pipes 100 installed on a section **90*a* of the graded steam duct 90, and an induced draft fan 102 for creating an upward flow of air through the module. The heat pipes 100 are, in this instance, arranged in two rows forming a Y configuration and the fan 102 is suitably mounted at the upper end thereof. The heat pipes 100 have flanges 100*c* which are bolted to the upper wall 90*b* of the steam duct section 90*a*. Of course, the upper wall 90*b* or part of it can be initially separate from the rest of the duct section 90*a* when the heat pipe flanges 100*c* are bolted to such unattached wall or part. The lower portions 100*a* of the heat pipes 100 extend down vertically into the steam duct section 90*a*, and the upper portions 100*b* are appropriately finned and exposed to the atmosphere. Thus, the heat pipes 100 couple the steam flowing in the duct section 90*a*** thermally with the atmosphere exterior thereto.

The space between the angled upper portions of the heat pipes 100 are preferably closed at the front and back ends of the Y configuration module y by plates 126 as illustrated in FIG. 7. The steam duct section **90*a* can have mounting arms 128 which are normally attached to adjacent support rails (not shown here). The upper fan support plate 130 of the module y can also have mounting arms 132 which are normally attached to respective support posts (also not shown here). The upper ends of the heat pipes 100 are, of course, attached to side portions of the plate 130. Although only a single row of heat pipes 100 is used to form each side of the Y configuration in FIG. 7**, multiple rows may be preferably used instead to form each of the two sides.

Summarizing, some of the advantages of the dry cooling system S (FIG. 3) and its Y configuration heat pipe modules y (FIG. 7) are as follows. The system and modules S and Y are exceptionally simple in structure and operation compared to the present conventional cooling towers and their cells or modules. The total size of the associated steam ducts is significantly reduced as is the overall land area required versus the other systems which use empty plenums, towers and large shell structures. Since turbine exhaust steam is confined in the graded duct 90 of the dry cooling system S and not circulated through the heat pipes 100 as is the exhaust steam circulated through the cooling coils 44 in the system 20 of FIG. 1, the number of potential vacuum leaks is greatly reduced. Power needed to circulate water to a dry cooling tower as in the system 50 of FIG. 2 is also not required in the system S. Further, all condensate return piping can be put underground, if desired, in the dry cooling system S to preclude freezing of any condensate remaining in the piping during shutdown of the system in the winter. Because the exhaust steam and condensate never enter small diameter, remotely located tubes or ducts, a further potential for freezing of condensate with expansion and bursting of the duct is eliminated (especially as compared with system 20 of FIG. 1).

The Y configuration of the heat pipe modules y in the system S allows natural convection to aid airflow (heated air bouyancy a few percent of required $\Delta P$), and allows the wind to aid rather than hurt fan performance as may occur in the horizontal or A-shaped module configurations, for example. The heat pipe modules y have the advantage of providing versatility in the selection of the most economical fan size through variation of the number of heat pipes per module and the angle between the upper heat pipe portions. Versalitity in layout of the Y configuration will help produce cooling modules y which minimize ingestion of discharged (heated) cooling air back into the modules.

Figure 8:
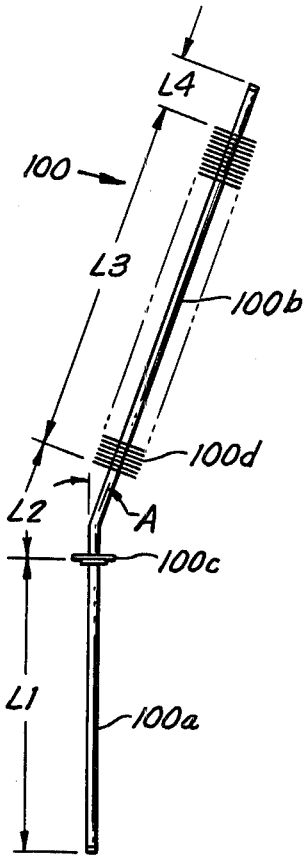
FIG. 8 is a front elevational view of a heat pipe element used in the Y configuration cell or module of FIG. 7.

FIG. 8 is a front elevational view of a heat pipe 100 used in the Y configuration cooling module y shown in FIG. 7. The heat pipe 100 is separated into lower and upper portions 100*a* and 100*b* by a mounting flange 100*c*. The lower portion 100*a* is an unfinned section of length L1, and the upper portion 100*b* has an adiabatic section of length L2, a finned section of length L3 and an unfinned section of length L4. The heat pipe 100 has a bend in its adiabatic section of an angle A. The number of heat pipes 100 used in each module y and the total required length are, of course, dependent basically upon the amount of heat to be rejected. Thus, length L1 can be 8 to 12 ft, length L2 can be 3 to 5 ft, length L3 can be 18 to 24 ft and length L4 can be 0 to 1 ft. The bend angle A for these lengths can be approximately 22 degrees, for example.

As used in the cooling module y (FIGS. 3 and 7), the heat pipe 100 illustratively is of carbon steel tube material and 5.08 cm (2.0 in) bare tube outside diameter with a 0.241 cm (0.095 in) wall thickness. The fins 100*d* can be of aluminum material and of a continuous helical (nonsegmented) configuration. Fin height is 2.86 cm (1.125 in), stock thickness of 0.066 cm (0.026 in) and spacing of 3.54 fins/cm (9 fins/in), for example. The length L1 can be 3.7 m (12 ft), length L2 can be 1.5 m (5 ft), length L3 can be 6.1 m (20 ft) and length L4 can be 5 cm (2 in). Ammonia is the preferred choice of working fluid for the heat pipe 100.

Figure 9:
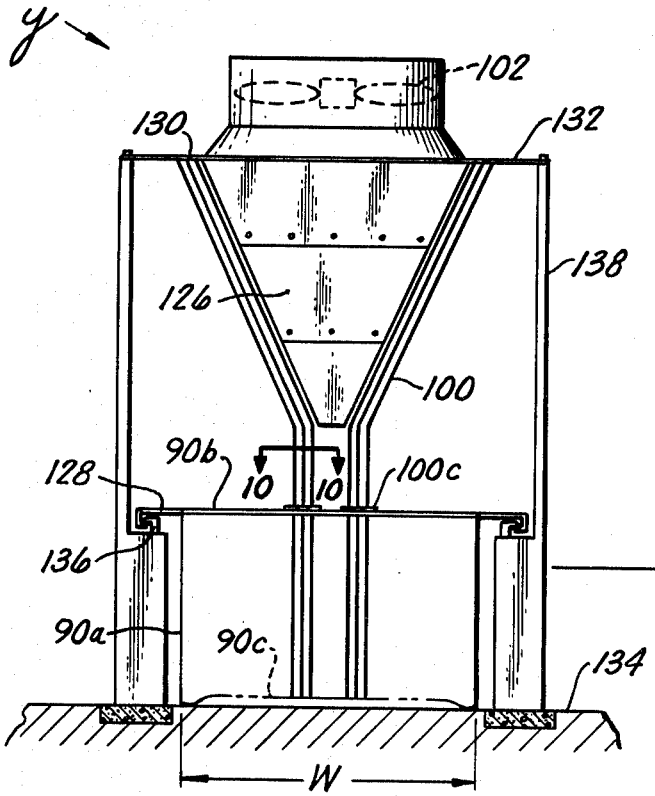
FIG. 9 is a front elevational view of a Y configuration cell or module, having multiple rows of heat pipes, installed to a steam duct section and both mounted on support posts.

FIG. 9 is a front elevational view of a Y configuration cooling module y including multiple rows of heat pipes 100 installed to the steam duct section 90*a* of the graded duct 90 (FIG. 3), and an induced draft fan 102 mounted at the top of the module. The heat pipes 100 are, in this instance, arranged in two sets of three rows each to form the Y configuration. The heat pipes 100 are attached by their flanges 100*c* to the upper wall 90*b* of the duct section 90*a* which is illustratively shown resting on the ground 134 to help support the weight of the heat pipes, end plates 126 and the fan 102. The mounting arms 128 of the upper wall 90*b* are normally attached to adjacent support rails 136 mounted on support posts 138. The upper ends of the heat pipes 100 are attached to the sides of fan support plate 130 having mounting arms 132 which are also normally attached to the upper ends of the support posts 138. The main weight is in the heat pipes 100 and this weight is largely carried by the upper wall 90*b* of the duct section 90*a* resting on the ground 134.

It may be preferable to support the steam duct section 90*a* by its mounting arms 128 on the rails 136 so that the duct section is held (raised) well above the ground 134. In this instance, the support rails 136 can be easily adjusted in height to control the grade of the steam duct 90. It may also be preferable to use a slightly convex (upwards) lower wall 90*c* (indicated in phantom lines in FIG. 9) to provide longitudinal side channels or gutters to collect and carry the condensate to its hot well 96. This is particularly desirable for the steam duct 90' (FIG. 4) which is graded in a direction opposite to the steam duct 90 (FIG. 3) such that the condensate flows counter to that of steam.

In the illustrative cooling module y of FIG. 9 having six rows of heat pipes 100, there are 39 heat pipes per row and a total of 234 heat pipes per module. The distance between the two sets of three rows each of heat pipes 100 is, for example, 0.61 m (2 ft) between the middle two rows. The module y has an exemplary length of 4.6 m (15 ft) and width at the top of 5.5 m (18 ft). Diameter of the fan 102 for this illustrative module y is 4.3 m (14 ft) and module face velocity of air flow is 2.03 m/sec (400 ft/min), for example. For a 500-megawatt electric (MWe) power plant, the system S as depicted in FIG. 3 would include approximately 260 to 300 of the cooling module y (FIG. 9) with multiple rows of heat pipes 100.

Figure 10:
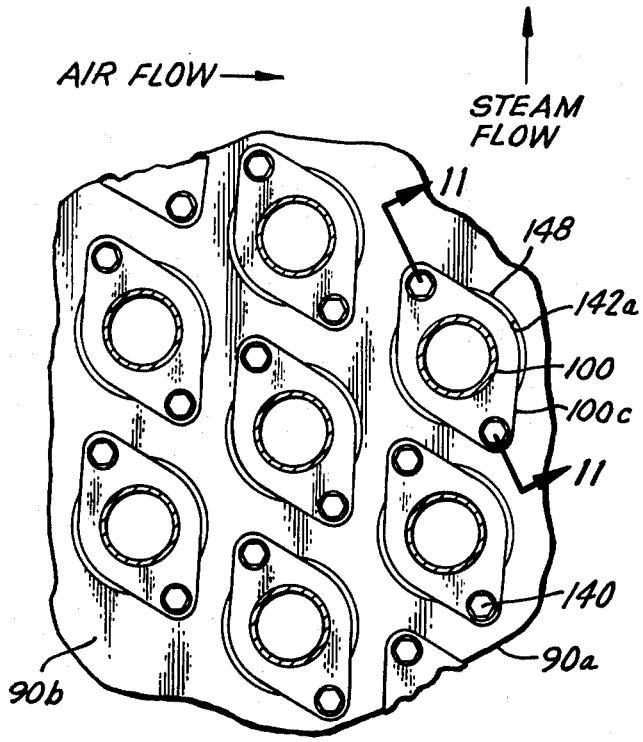
FIG. 10 is a fragmentary, cross-sectional, plan view of the multiple rows of heat pipes installed to the steam duct section as taken along the line 10—10 indicated in FIG. 9.

FIG. 10 is a fragmentary, cross-sectional, plan view of one set of the multiple rows of heat pipes 100 installed to the steam duct section 90*a* as taken along the line 10—10 indicated in FIG. 9. The mounting flanges 100*c* of the heat pipes 100 are attached to the upper wall 90*b* of the duct section 90*a* by bolts 140. It can be seen that the axes of the heat pipes 100 are positioned at (pass through) the corners of equilateral triangles in the plan view of FIG. 10. The longitudinal pitch between heat pipes 100 in each row is 10.16 cm (4.0 in) and the transverse pitch of the heat pipes between adjacent rows is 11.75 cm (4.625 in), for example. Although heat pipe fins 100*d* (FIG. 8) were not indicated on the upper portions of the heat pipes 100 shown in FIG. 9 for clarity of illustration, fin tip clearance is 0.95 cm (0.375 in) for the pitch arrangement noted above.

Figure 11:
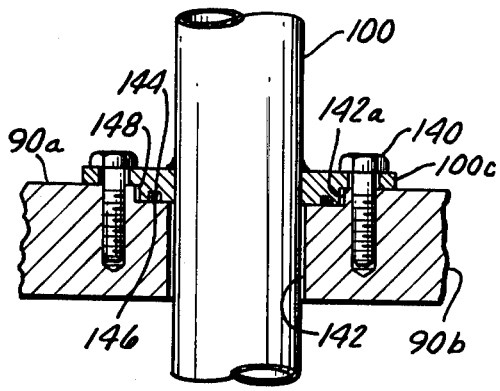
FIG. 11 is a fragmentary, sectional, elevation view of the installation of a heat pipe to the steam duct section as taken along the line 11—11 indicated in FIG. 10.

FIG. 11 is a fragmentary, sectional, elevation view of the installation of a heat pipe 100 to the upper wall 90*b* of the steam duct section 90*a* as taken along the line 11—11 indicated in FIG. 10. The mounting flange 100*c* is, for example, welded to the heat pipe 100 which is inserted through the counterbored hole 142 in the upper wall 90*b*. The heat pipe flange 100*c* is fastened to the upper wall 90*b* by bolts 140. The upper wall 90*b* of the duct section 90*a* is $1\frac{3}{4}$ in thick and the other walls of the duct section are $\frac{1}{4}$ in thick, for example. The hole 142 has a diameter of $2\frac{1}{8}$ in to accommodate the 2.0 in diameter heat pipe 100. The counterbored or recessed portion 142*a* of hole 142 has a diameter of $3\frac{1}{2}$ in and a depth of $\frac{1}{4}$ in, for example.

A small channel or groove 144 having a radially outer diameter of 3.0 in is provided in the underside of the flange 100*c* to contain an ethylene propylene D-ring seal 146 which is similar to the lower half of an ordinary O-ring seal. The lower (plug) portion of the flange 100*c* fits in the counterbored portion 142*a* of the hole 142. This lower (plug) portion of the flange 100*c* has a diameter of $3\frac{1}{4}$ in and forms an annular space 148 of $\frac{1}{8}$ in thickness with the wall of the counterbored portion 142*a* of the hole 142. It can be seen from FIG. 10 that most of the annular space 148 is not covered by the flangef 100*c* and may be readily viewed for leak checks. This is accomplished easily by pouring clear or colored water (or other liquid) into the annular space 148 and observing whether or not the water is visibly drawn into the steam duct 90 (FIGS. 3 and 7) by the vacuum therein. In practice, water is simply thrown from a bucket onto the upper wall 90*b* around the heat pipes 100 and watching to see where the water is noticeably sucked into the working steam duct 90. The annular space 148 is a gauge reservoir which would communicate with the hole 142 except for the seal 146. Of course, indicia means (not shown) can be provided at the annular space 148 to gauge the magnitude of any leak more accurately with timing. A variation of this is to adapt each annular space 148 for connection with a calibrated supply bottle of a suitable liquid or even gas. In this instance, the supply bottle is then the gauge reservoir.

Figure 12:
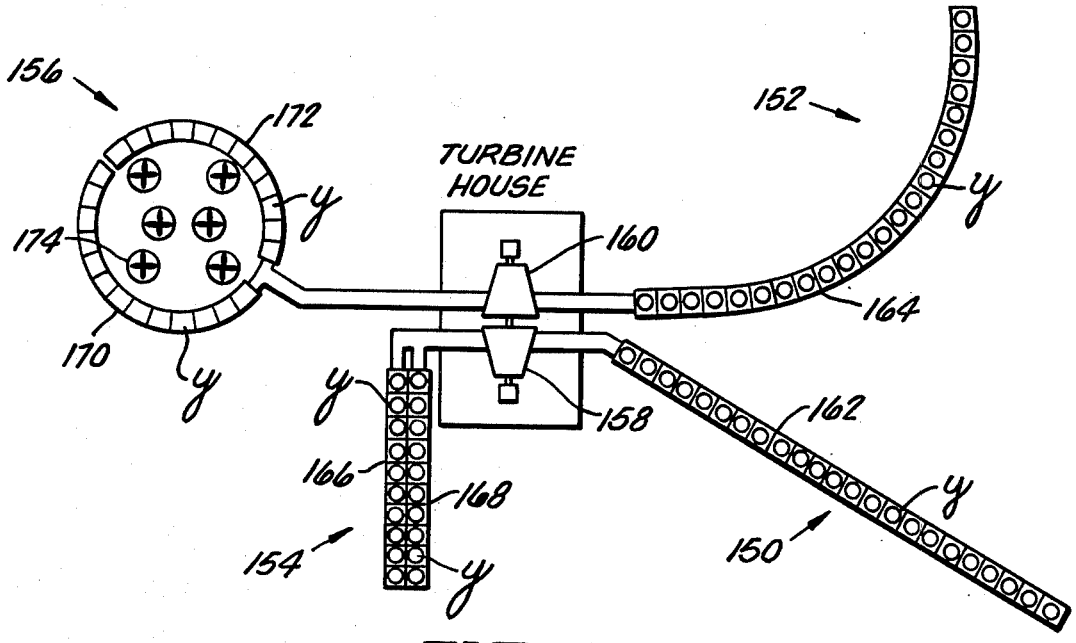
FIG. 12 is a top plan view, shown in simplified and schematic form, of four dry cooling systems wherein the cells or modules thereof are illustratively arranged in different patterns varying according to variously assumed environmental conditions at their respective locations.

FIG. 12 is a top plan view, shown in simplified and schematic form, of four dry cooling systems 150, 152, 154 and 156 wherein the heat pipe modules y thereof are illustratively arranged in different patterns varying according to variously assumed environmental conditions at their respective locations. The systems 150, 152, 154 and 156 are connected to receive the exhaust steam from turbines 158 and 160, and are arranged in patterns dependent upon the prevailing wind direction at their respective locations, the contours of the surrounding terrain and the available land area, for example. Thus, in the system 150, the exhaust steam from turbine 158 is directed into a long graded duct 162 and the cooling modules y are positioned along its length in a single straight row. In this instance, the prevailing wind direction is assumed to be perpendicularly broadside to the straight row.

In the system 152, it is assumed that the surrounding terrain funnels (channels and spreads) the prevailing wind such that the graded steam duct 164 and its cooling modules y can be advantageously arranged in a curved row to catch the wind. In the system 154, the available land area is assumed to be limited in length. In this instance, the exhaust steam from the turbine 158 is directed into two adjacent and parallel ducts 166 and 168. The cooling modules y are positioned along the lengths of these ducts 166 and 168 in two adjacent and parallel rows. These parallel rows are, of course, much shorter in length than the single row system 150.

Finally, in the system 156, it is assumed that a larger land area is available but it is desired to reduce the number of fans used. The exhaust steam from turbine 160 is directed into two graded ducts 170 and 172 which are semicircularly curved along their lengths so that the two ducts together form a circular pattern. The cooling modules y positioned along the lengths of the semicircularly curved ducts 170 and 172 do not include draft fans, however, and only a few larger fans 174 are located in the area surrounded by the circular duct pattern. These larger fans 174 are utilized to induce an air flow through the surrounding modules y arranged in the circular pattern.

Although the dry cooling module and system of this invention have been designed primarily to dissipate the waste heat from the exhausted working fluid of a steam turbine, similar structure can be used with turbines exhausting other working fluids such as ammonia, potassium, mercury, etc. Thus, while certain exemplary embodiments of this invention have been described above and shown in the accompanying drawings, it is to be understood that such embodiments are merely illustrative of, and not restrictive on, the broad invention and that I do not desire to be limited in my invention to the specific arrangements, constructions or structures described or shown, for various modifications thereof may occur to persons having ordinary skill in the art.

I claim:

1. Leak check means for an installation of a heat pipe mounted to a normally upper wall of a duct means, said heat pipe extending through a hole in said upper wall and said leak check means comprising:

a reservoir space defined by heat pipe structure cooperatively engaging normally upper wall structure of said duct means, said reservoir space normally communicating with said duct means through said hole in said upper wall thereof; and seal means for blocking communication of said reservoir space with said duct means through said hole in said upper wall whereby a leak check can be made by supplying a fluid to said reservoir space and observing any loss of said fluid into said duct means through said seal means and said hole in said upper wall of said duct means.

2. The invention as defined in claim 1 wherein said duct means operates under a vacuum condition, and said reservoir space includes an annular space formed around and located a predetermined radial distance from said hole in said upper wall of said duct means.

3. A dry cooling system comprising:

duct means for carrying a relatively hot fluid therein, said duct means including a normally lower wall which is longitudinally graded in a predetermined direction;

a plurality of heat pipes normally installed vertically in a predetermined configuration on said duct means and coupling said hot fluid therein thermally with a cooling medium exterior thereto;

means for producing a flow of said cooling medium past exposed portions of said heat pipes whereby heat picked up by the unexposed portions of said heat pipes is transported to said exposed heat pipe portions and transferred to said cooling medium;

leak check means for an installation of a heat pipe mounted to a normally upper wall of a duct means, said heat pipe extending through a hole in said upper wall and said leak check means comprising; a reservoir space defined by heat pipe structure cooperatively engaging normally upper wall structure of said duct means, said reservoir space normally communicating with said duct means through said hole in said upper wall thereof, and seal means for blocking communication of said reservoir space with said duct means through said hole in said upper wall whereby a leak check can be made by supplying a fluid to said reservoir space and observing any loss of said fluid into said duct means through said seal means and said hole in said upper wall of said duct means.

* * * * *